US005480310A

United States Patent [19]

Baum

[11] Patent Number: 5,480,310

[45] Date of Patent: Jan. 2, 1996

[54] CONNECTOR GROUND CLIP

[75] Inventor: Thomas M. Baum, Fuquay-Varina, N.C.

[73] Assignee: Raychem Corporation, Menlo Park, Calif.

[21] Appl. No.: 144,074

[22] Filed: Oct. 28, 1993

[51] Int. Cl.[6] ..... H01R 4/66

[52] U.S. Cl. ..... 439/94; 439/716

[58] Field of Search ..... 439/94, 716, 717, 439/95

[56] References Cited

U.S. PATENT DOCUMENTS

| | | | |
|---|---|---|---|
| 2,981,922 | 4/1961 | Valkenburg et al. . | |
| 3,123,425 | 3/1964 | Blanchet . | |
| 3,173,738 | 3/1965 | Gluntz . | |
| 3,201,747 | 8/1965 | Blanchet . | |
| 3,236,975 | 2/1966 | Woodrow et al. . | |
| 3,627,900 | 12/1971 | Robinson | 439/95 X |
| 3,766,515 | 10/1973 | Debaigt . | |
| 3,970,276 | 7/1976 | Debaigt . | |
| 3,992,074 | 11/1976 | Rymer . | |
| 4,113,982 | 9/1978 | Glaesel . | |
| 4,157,858 | 6/1979 | Debaigt . | |
| 4,171,861 | 10/1979 | Hohorst . | |
| 4,220,392 | 9/1980 | Debaigt . | |
| 4,268,108 | 5/1981 | Debaigt . | |
| 4,269,471 | 5/1981 | Woertz . | |
| 4,647,141 | 3/1987 | Muench et al. . | |
| 4,707,563 | 11/1987 | Conrad et al. . | |
| 4,776,815 | 10/1988 | Baillet et al. . | |
| 4,900,275 | 2/1990 | Fasano . | |
| 4,921,445 | 5/1990 | Herbert . | |
| 4,993,959 | 2/1991 | Randolph . | |
| 5,022,873 | 6/1991 | Kollmann | 439/716 |
| 5,047,604 | 9/1991 | Grass et al. . | |
| 5,090,922 | 2/1992 | Rymer et al. . | |
| 5,192,227 | 3/1993 | Bales | 439/716 X |

FOREIGN PATENT DOCUMENTS

| | | | |
|---|---|---|---|
| 3345803A1 | 7/1985 | Germany . | |
| 8711525.5 | 12/1987 | Germany . | |
| 9318239.2 | 5/1994 | Germany . | |
| 9401533.3 | 5/1994 | Germany . | |
| 2026788 | 2/1980 | United Kingdom | 439/716 |

OTHER PUBLICATIONS

Macainary's Handbook, 1918 ED., p. 333.

*Primary Examiner*—David L. Pirlot
*Assistant Examiner*—Daniel Wittels
*Attorney, Agent, or Firm*—Herbert G. Burkard; William D. Zahrt, II

[57] ABSTRACT

A telecommunications connector (10) includes a ground clip (15) which resiliently engages the rim (17*a*) of a grounding bus rail (12). Opposing fingers (25, 26) grip the rim (17*a*). A pivot finger (26) first grips the rim (17*a*), and then the connector (10) is rotated (28) onto the rim. Tangs (45) also engage the rim (17*a*), and the connector (10) and clip (15) are locked in position on the rail (12) by jaws (47). Entry wings (30, 41) assist in opening the fingers (25, 26) and a ground lead receiving pocket (35) on the dip (15).

16 Claims, 3 Drawing Sheets

CONNECTOR GROUND CLIP

BACKGROUND OF THE INVENTION

The present invention relates to telecommunications connectors, and more particularly to a new and improved electrical grounding and ground clip system for use in connectors and terminals designed to be mounted side-by-side by clipping onto an electrically grounded metallic support rail.

The telecommunications industry is increasingly requiring that high-density, low-cost connector arrays combine more and more performance into less and less space, and be operable with less and less manual labor. However, it is also expected that the reliability of the electrical connections will continue to be at least as dependable as before, and preferably will become more environmentally secure and reliable. Increasingly, labor-saving innovations such as insulation-displacing connectors (IDC's) are becoming standard in telecommunications terminals. These well-known terminations enable the user to connect a wire quickly to a terminal without first removing the insulation and then having to tighten a screw-driven binding post.

For connectors and terminals designed to be mounted side-by-side by clipping onto an electrically grounded metallic support rail, however, many designs still typically require tightening a screw to complete the ground connection to the rail. Designs which have eliminated this labor-intensive delay appear to be rare. One such configuration, shown in U.S. Pat. No. 4,171,861, describes the use of an angled flat leaf spring in the rail-engaging groove of a ground-wire bridge to assure a resilient engagement with the grounding rail. Mention is also made that the end of the ground-wire bridge itself could be made resilient to render the spring superfluous, although no teaching is given of how this is to be accomplished. Thus, while a connection device is disclosed which can be hooked to one side of the grounding rail and then rotated and snapped into position on the other side of the rail, the ground-wire bridge itself appears to require assistance (the angled leaf spring) to achieve sufficient resilience for reliable tool-less installation.

A need therefore remains for new and improved telecommunications methods and apparatus which provide a ground clip connector which is sufficiently flexible, resilient, and robust for reliably and tool-lessly establishing an electrical ground connection to a grounding bus rail.

SUMMARY OF THE INVENTION

Briefly, the present invention meets the above needs and purposes with a new and improved ground dip system for use in connectors and terminals designed to be mounted side-by-side by clipping onto an electrically grounded metallic support or bus rail. More particularly, the present invention includes a housing with tangs which can slip underneath the rail along one rim thereof when the housing is placed at an angle thereon. The housing is then rotated downwardly from that angle and around the rim, until jaws on the housing snap onto and capture the opposing rim of the grounding bus rail. This secures the housing to the rail without the need for tools.

During attachment of the housing onto the rail, a ground clip carried in the housing simultaneously makes an electrical ground connection to the rail. The ground clip includes several fingers which oppose one another for resiliently engaging the rim of the grounding bus rail along with the tangs. The spacing between the opposing fingers is such that they are resiliently flexed apart as the housing rotates the fingers into the installed position on the rail. The flexible spreading of the fingers during installation is designed to be significant, yet resilient, so that a firm and reliable electrical connection to ground is assured despite ordinary dimensional variations in the ground rail resulting from manufacturing tolerances, damage in use, and so forth.

To provide this strength, flexibility, and resilience, the draw grain of the metal in the sheet from which the ground clip is formed is longitudinal ("with the grain"), and the bends in the sheet which form the resilient fingers and other resilient aspects of the clip, as desired, are formed across the grain. In a broader sense, the bend axes are substantially parallel to the plane defined by the longitudinal and transverse axes of the sheet to provide for a resilient flexing along the neutral line thereof. Thus, by flexing along the neutral line, a firm yet accommodating grip to the ground rail rim is assured.

In the preferred embodiment, the clip includes additional features which further enhance its performance. For example, it is preferably formed with multiple spring bends, such as into an S-shape, between the rail-engaging fingers and the portion of the clip where provision is made for connecting to an electrical conductor which is to be grounded. Such a grounding provision can be, for example, a resilient pocket into which a ground lead can be inserted and gripped. In the preferred embodiment, the fingers which are rotated onto the ground rail, and the opening to the pocket, may each be provided with entry wings which pry or cam them open. In this manner, the initial spacing may be quite small, so that, by the aid of the entry wings, additional resilient flexing of the ground clip may be effected, for an even firmer and more widely tolerant connection.

In one aspect of the invention, therefore, it is an object to provide a connector ground clip for tool-lessly establishing an electrical ground connection to a grounding bus rail, in which the clip includes a metallic sheet having longitudinal and transverse axes, in which there is a provision in the sheet for connecting to an electrical conductor to be grounded, and in which there are opposing fingers formed in the sheet for resiliently engaging the rim of a grounding bus rail to establish an electrical ground connection therewith, the fingers being formed in the sheet along bend axes substantially parallel to the plane defined by the longitudinal and transverse axes to provide for resilient flexing of the ground clip along the neutral line thereof for maximizing the flexibility and resiliency of the fingers when engaging such a rail, and the fingers being formed and spaced in the sheet such that they are flexibly spread when in a predetermined position on the rail to resiliently apply pressure to the rail for improved ground connection therewith. One of the fingers of the clip may include a pivot for engaging the rim of such a rail for rotating the fingers around the pivot into the predetermined position on the rail; the clip may include an entry wing on the end of at least one of the fingers opposed to the pivot, for engaging such a rail and resiliently prying the fingers open when rotated into the predetermined position, to provide for increasing the gripping force of the fingers on the rail and accommodating variations in rail sizes; the clip may be a single metallic sheet having a spring portion therein, the fingers being formed in one end of the sheet, and the spring portion and the provision for connecting to a conductor being formed on the sheet such that the spring portion is between the provision and the fingers, the spring portion thereby at least partially mechanically decoupling the fingers from the provision for connecting. The spring portion may define an S-shaped resilient fold in the sheet, and the provision for connecting to a conductor may include a pocket formed by the fold on the end of the sheet opposite the fingers for resiliently receiving and gripping a lead to be grounded; there may also be at least one entry wing on the pocket for resiliently prying the pocket open when such a lead is inserted into the pocket, to provide for increasing the gripping force of the pocket on the lead and accommodating variations in lead sizes.

In another aspect of the invention, it is an object to provide a connector ground clip for tool-lessly establishing an electrical ground connection to a grounding bus rail, the clip having a single metallic sheet with longitudinal and transverse axes, the grain of the metal being drawn in the longitudinal direction, and the sheet being formed into an S-shaped spring which defines a resilient fold in the sheet on one end thereof, the fold further defining a pocket for resiliently receiving and gripping a conductive lead to be grounded, at least one entry wing on the pocket for resiliently prying the pocket open when such a lead is inserted into the pocket, to provide for increasing the gripping force of the pocket on the lead and accommodating variations in lead sizes, opposing fingers formed in the end of the sheet opposite the pocket for resiliently engaging the rim of a grounding bus rail to establish an electrical ground connection therewith, the fingers being formed in the sheet along bend axes across the grain of the sheet and thus substantially parallel to the transverse axis of the sheet, the sheet being substantially free of bends around axes substantially parallel to the longitudinal axis thereof, to provide for resilient flexing of the ground clip along the neutral line thereof for maximizing the flexibility and resiliency limits of the fingers when engaging such a rail, the S-shaped spring at least partially decoupling the fingers from the pocket, and the fingers being formed and spaced in the sheet such that they are flexibly spread when in a predetermined position on the rail to resiliently apply pressure to the rail for improved ground connection therewith, at least one of the fingers having a pivot for engaging the rim of such a rail for rotating the fingers around the pivot into the predetermined position on the rail, and having an entry wing on the end of at least one of the fingers opposed to the pivot, for engaging such a rail and resiliently prying the fingers open when rotated into the predetermined position, to provide for increasing the gripping force of the fingers on the rail and accommodating variations in rail sizes.

In another aspect of the invention, it is an object to provide a connector for mounting on and for tool-lessly establishing an electrical connection to a grounding bus rail, the connector including a housing having means for terminating at least one telecommunications conductor, rail-engaging members on the housing for engaging such a grounding bus rail and holding the housing thereon, a metallic sheet having longitudinal and transverse axes and being formed into a ground clip on the housing for establishing an electrical ground connection to the grounding bus rail, a provision in the sheet for connecting to an electrical conductor to be grounded, and opposing fingers formed in the sheet for resiliently engaging the rim of a grounding bus rail to establish such an electrical ground connection therewith, the fingers being formed in the sheet along bend axes substantially parallel to the plane defined by the longitudinal and transverse axes to provide for resilient flexing of the ground clip along the neutral line thereof for maximizing the flexibility and resiliency of the fingers when engaging such a rail, the fingers being formed and spaced in the sheet such that they are flexibly spread when in a predetermined position on the rail to resiliently apply pressure to the rail for improved ground connection therewith, and the fingers being positioned on the housing such that the housing holds the ground clip in the predetermined position when the rail-engaging members are engaged on such a grounding bus rail. The connector may include at least one component therein requiring an electrical connection to ground, an electrical connection between the component and the provision for connecting, and a releasable catch assembly incorporated into the rail-engaging members for releasably engaging such a rail to releasably hold the housing and the ground clip thereon.

In still another aspect of the invention, it is an object to provide a blank for a connector ground clip for tool-lessly establishing an electrical ground connection to a grounding bus rail, the blank including a single metallic sheet having longitudinal and transverse axes, fingers extending longitudinally in one longitudinal end of the sheet for being shaped along bend axes substantially parallel to the plane defined by the longitudinal and transverse axes, a pivot region in at least one of the fingers for being shaped into a pivot to engage the rim of such a rail for rotating the fingers around the pivot, an entry wing region on the end of at least one other finger for being shaped to engage such a rail upon such rotation about the pivot, at least one spring region longitudinally inwardly on the sheet from the fingers, a pocket-forming region on the end of the sheet longitudinally opposite the fingers for being shaped into a pocket for receiving and gripping a conductive lead to be grounded, and at least one entry wing region formed in the pocket-forming region for being shaped to pry such a pocket open when such a lead is inserted into such a pocket. The grain of the metal in the blank may be drawn in the longitudinal direction, the at least one spring region may be a first spring region, the pocket-forming region and the first spring region may be at least partially transversely adjacent one another, and a second spring region may be provided on the sheet between the first spring region and the end of the sheet longitudinally opposite the fingers, the spring regions thereby providing for foxing the blank into an S-shape.

In another aspect of the invention, it is an object to provide a method for tool-lessly engaging the rim of a grounding bus rail to establish an electrical ground connection therewith, the method including the step of engaging the rim of such a grounding bus rail with a clip formed from a metallic sheet having longitudinal and transverse axes and including a provision for connecting to an electrical conductor to be grounded, the sheet having opposing fingers formed therein for resiliently engaging the rim to establish an electrical ground connection therewith, and the fingers being formed in the sheet along bend axes substantially parallel to the plane defined by the longitudinal and transverse axes to provide for resilient flexing of the ground clip along the neutral line thereof for maximizing the flexibility and resiliency of the fingers when engaging such a rail, the method further including positioning the fingers in a predetermined position on the rail, and, while positioning the fingers in the predetermined position, flexibly spreading the fingers around at least one of the bend axes to resiliently apply pressure to the rail for improved ground connection therewith. The positioning step may include engaging the rim of such a rail with a pivot on at least one of the fingers and rotating the fingers around the pivot into the predetermined position on the rail. The method may also include, with an entry wing on the end of at least one of the fingers opposed to the pivot, engaging such a rail with the wing and resiliently prying the fingers open when rotated into the predetermined position, to provide for increasing the gripping force of the fingers on the rail and accommodating variations in rail sizes. The ground clip may be a single metallic sheet having a spring portion therein, the fingers may be formed in one end of the sheet, and the spring portion may be between the fingers and the provision for connecting to a conductor. The method may further include, by means of the spring portion, at least partially mechanically decoupling the fingers from the provision for connecting. The spring portion may be an S-shaped resilient fold in the sheet, and the provision for connecting to a conductor may be a pocket formed by the fold on the end of the sheet opposite the fingers for resiliently receiving and gripping a lead to be grounded. The method may further include, with at least one entry wing on the pocket, resiliently prying the pocket open when such a lead is inserted into the pocket, to provide for increasing the gripping force of the pocket on the lead and accommodating variations in lead sizes.

In another aspect of the invention, it is an object to provide a method for tool-lessly engaging the rim of a grounding bus rail to establish an electrical ground connection therewith, the method including the steps of engaging the rim of such a grounding bus rail with a ground clip formed from a single metallic sheet having longitudinal and transverse axes, the grain of the metal being drawn in the longitudinal direction, the sheet having a spring portion forming an S-shaped resilient fold therein, a provision for connecting to an electrical conductor to be grounded, and opposing fingers formed in one end of the sheet for resiliently engaging the rim to establish an electrical ground connection therewith, the spring portion being between the fingers and the provision for connecting to a conductor, the provision for connecting to a conductor being a pocket formed by the fold on the end of the sheet opposite the fingers for resiliently receiving and gripping a lead to be grounded, and the fingers being formed in the sheet along bend axes across the grain of the sheet and thus substantially parallel to the transverse axis of the sheet, the sheet being substantially free of bends around axes substantially parallel to the longitudinal axis thereof, to provide for resilient flexing of the ground clip along the neutral line thereof for maximizing the flexibility and resiliency of the fingers when engaging such a rail, positioning the fingers in a predetermined position on the rail by engaging the rim of the rail with a pivot on at least one of the fingers and rotating the fingers around the pivot into the predetermined position on the rail, while positioning the fingers in the predetermined position, flexibly spreading the fingers around at least one of the bend axes to resiliently apply pressure to the rail for improved ground connection therewith, also while positioning the fingers in the predetermined position, with an entry wing on the end of at least one of the fingers opposed to the pivot, engaging the rail with the wing and resiliently prying the fingers open when rotated into the predetermined position, to provide for increasing the gripping force of the fingers on the rail and accommodating variations in rail sizes, with at least one entry wing on the pocket, resiliently prying the pocket open when such a lead is inserted into the pocket, to provide for increasing the gripping force of the pocket on the lead and accommodating variations in lead sizes, and by means of the spring portion, at least partially mechanically decoupling the fingers from the pocket.

It is therefore still another object of the present invention to provide such a new and improved telecommunications connector and method which can readily be used in a wide variety of applications, such as, for instance, site termination, crossconnects, and so forth, for tool-lessly establishing an electrical ground connection to a grounding bus rail; and to accomplish the above objects and purposes in an inexpensive, uncomplicated, durable, versatile, and reliable method and apparatus.

These and other objects and advantages of the invention will be apparent from the following description, the accompanying drawings, and the appended claims.

DESCRIPTION OF THE PREFERRED EMBODIMENT

Figure 1:
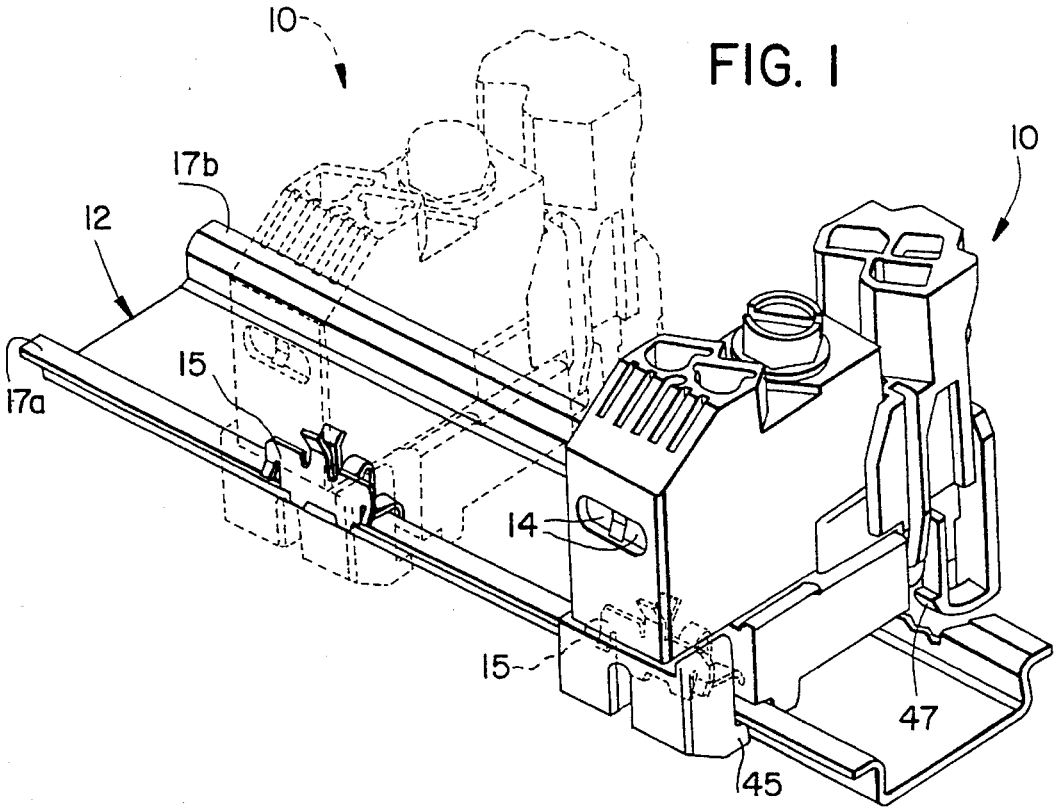
FIG. 1 is an isometric view of a connector according to the present invention mounted on a grounding bus rail, showing in phantom the ground clip of the present invention in position therein and thereon, and illustrated next thereto is a ground clip in position on the rail, with its connector housing shown in phantom.
Figure 2:
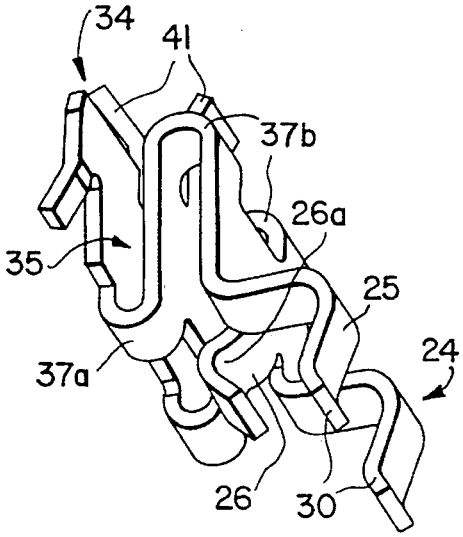
FIG. 2 is an isometric front and lower left view of the ground clip.

With reference to the drawings, the new and improved telecommunications connector for mounting on and for tool-lessly establishing an electrical connection to a grounding bus rail, and the method therefor according to the present invention, will now be described. FIG. 1 shows a connector 10 according to the present invention mounted on a grounding bus rail 12. Connector 10 incorporates suitable insulation displaying connectors (IDC's) (not shown), as well known in the art, for receiving telecommunications conductors (not shown) through ports 14 for electrically terminating the wires therein.

Figure 3:
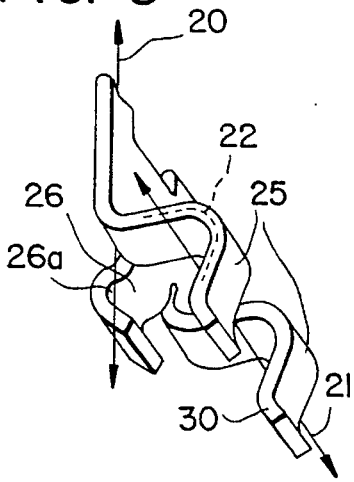
FIG. 3 is a fragment of the FIG. 2 clip showing the longitudinal axis, transverse axis, and neutral line thereof.
Figure 4:
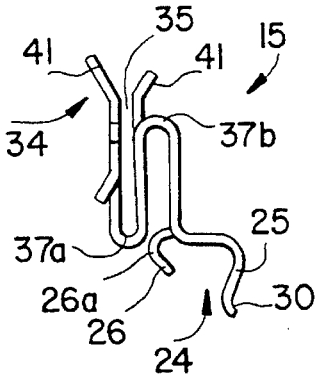
FIG. 4 is a side view of the clip.
Figure 5:
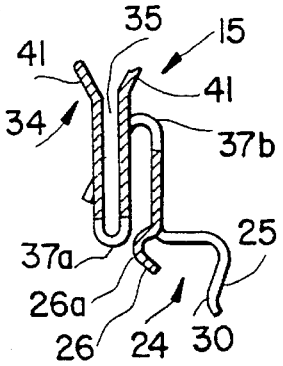
FIG. 5 is a cross-sectional view of the clip taken on line 5—5 in FIG. 6.
Figure 6:
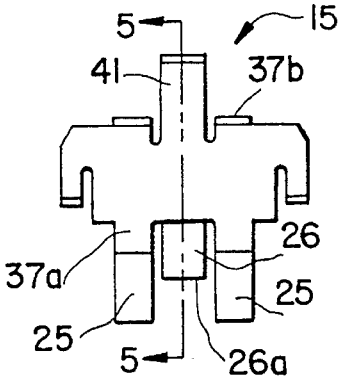
FIG. 6 is a rear view of the clip.
Figure 7:
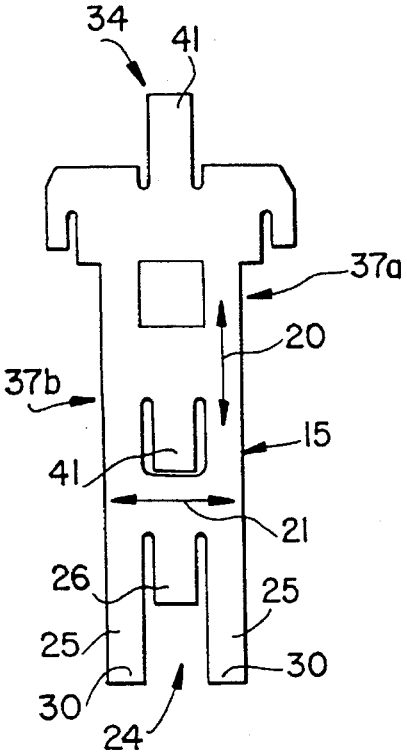
FIG. 7 is a top plan view of the blank from which the dip is formed.

Supported within the housing of connector 10 is a ground clip 15 which is held by connector 10 in position on rim 17*a* of the grounding bus raft 12. (Note that the term "rim" does not necessarily imply a ledge having an edge. It could also be a folded sheet, for example, as long as it presents an area, or "rim", which can be gripped.) Clip 15 is formed from a metallic sheet having longitudinal and transverse axes 20 and 21 respectively (FIGS. 3 and 7), the grain of the metal preferably being drawn in the longitudinal direction. Then, as can be seen in the drawings, the sheet is substantially free of bends around axes parallel to the longitudinal axis 20, and to axes perpendicular to the plane of the sheet. All the bends formed in the sheet are thus formed along bend axes across the grain of the sheet, substantially parallel to the transverse axis 21 of the sheet. This provides the best resilient flexing of the ground clip 15 along its neutral line 22, maximizing the flexibility and resiliency limits of the clip.

Figure 8:
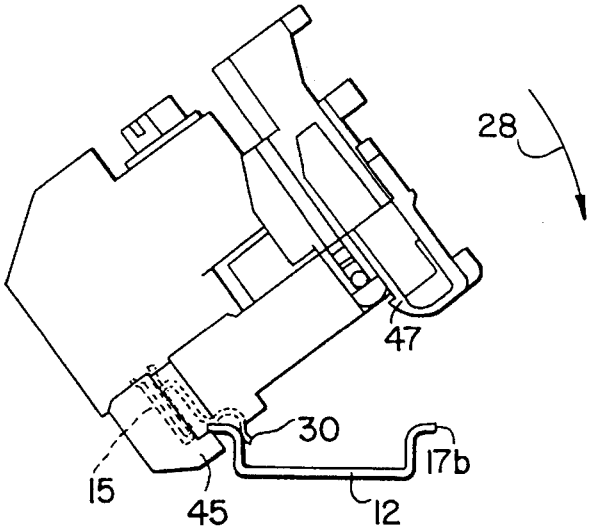
FIG. 8 is a side view of the FIG. 1 connector showing initial engagement of the connector housing and dip onto the grounding bus raft.
Figure 10:
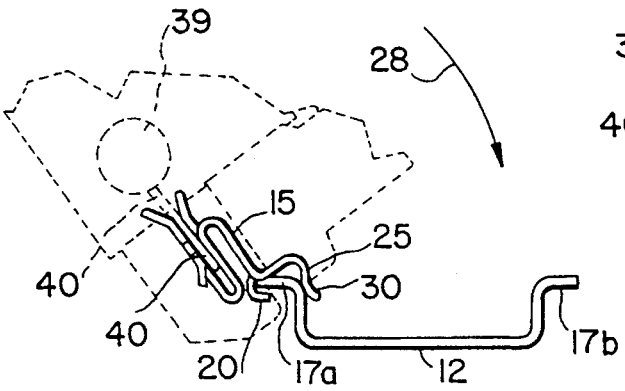
FIG. 10 is a slightly enlarged view of the rail and clip of FIG. 8, a fragment of the housing being shown in phantom.

On one longitudinal end 24 of the clip 15 are a pair of fingers 25 and an opposing finger 26. Finger 26 is formed into a pivot 26*a* for initially engaging the rim 17*a* of ground dip 15, as illustrated in FIGS. 8 and 10, during assembly of the connector 10 onto the rail 12. The clearance between fingers 25 and pivot finger 26 is less than the width of the rail rim 17*a* so that, as the connector 10 is rotated in the installation direction indicated by arrow 28 (FIGS. 8 and 10), the opposing fingers will be flexibly and resiliently spread. Advantageously, the ends of fingers 25 will be bent outwardly to form entry wings 30 for camming the fingers open as they are rotated onto rim 17*a*. Wings 30 thus allow the "at rest" (unflexed) spacing of the fingers 25 and 26 to be even closer, so that a net stronger gripping force will be provided on the rail when the fingers are fully separated, and also so that wider tolerances are provided, such as for rim size variations due to manufacturing tolerances, rail damage, and so forth.

On the end 34 of clip 15 longitudinally opposite end 24 is a pocket 35 formed by bend 37*a* of a pair of major bends 37*a* and 37*b* in the clip 15. Bends 37 provide an S-shaped spring configuration in the ground clip 15 which substantially decouples the fingers 25 and 26 from the pocket 35. Pocket 35 serves nicely as a provision in the clip 15 for connecting to an electrical conductor to be grounded. For example, an electrical device 39 (FIGS. 10 and 11), such as a gas discharge tube, may have a ground lead 40 which is resiliently captured in pocket 35. To improve the resilient engagement of pocket 35 on such a lead 40, the pocket preferably has entry wings 41 which dynamically function for pocket 35 similarly to the function of wings 30 for fingers 25.

Figure 9:
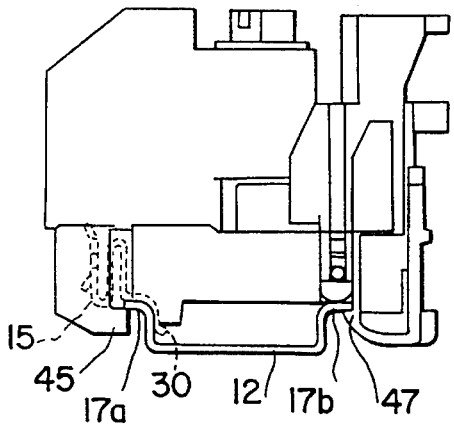
FIG. 9 is a view similar to FIG. 8 showing the connector housing and clip fully installed onto the rail.
Figure 11:
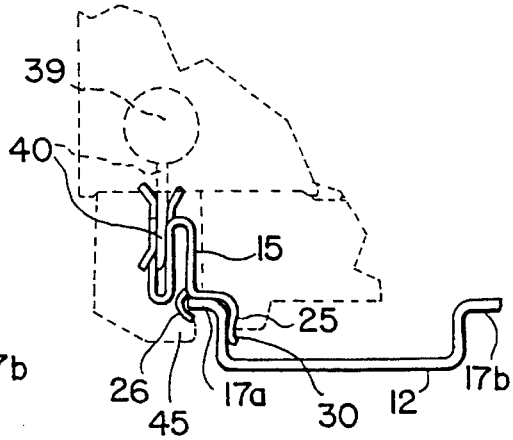
FIG. 11 is a view similar to FIG. 10 of the rail and clip of FIG. 9.

Referring to FIGS. 8–11, installation of the connector 10 and the ground clip 15 thereon is accomplished by first engaging tangs 45 and pivot finger 26 on the rim 17*a* of bus 12, the connector 10 being at an angle to the grounding bus rail 12 as illustrated in FIGS. 8 and 10. Connector 10 is then rotated downwardly in the direction of arrow 28, causing jaws 47 to engage and clip onto the opposite rim 17*b* of bus rail 12 (FIGS. 9 and 11 ). During this rotation, the entry wings 30 pry fingers 25 away from pivot finger 26, thus firmly and resiliently engaging rim 17*a* and providing a solid electrical ground connection therewith. As can be seen, no tools are thus required for installing the invention onto the rail 12.

Figure 12:
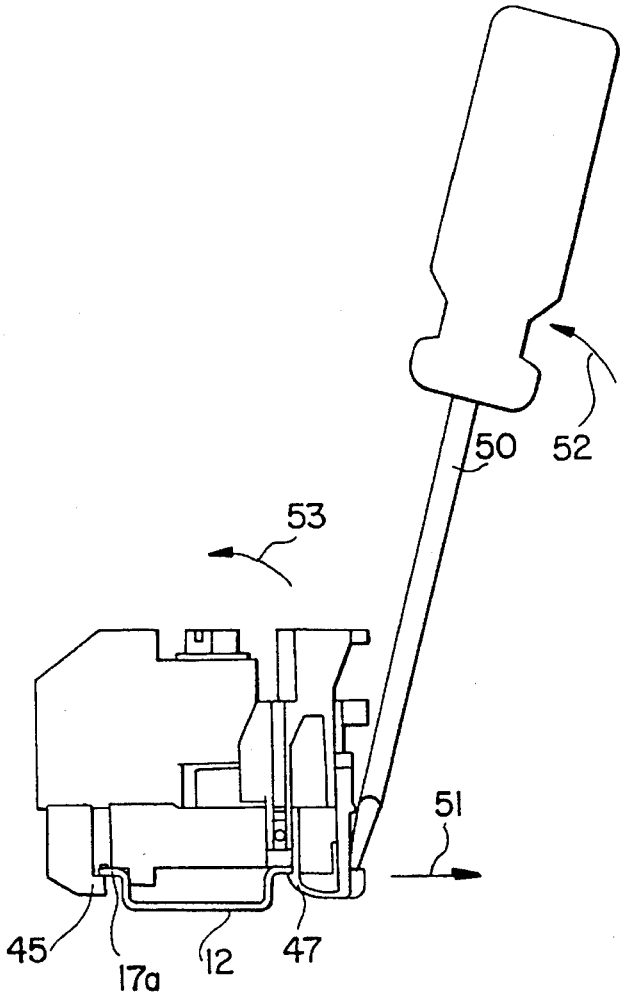
FIG. 12 illustrates removal of the connector from the rail.

Finally, FIG. 12 illustrates the easy removal of connector 10 from rail 12. Jaws 47 are simply engaged and pried loose from rim 17*b*, such as by a screwdriver 50. To move jaws 47 in the direction of arrow 51, thereby disengaging them from rim 17*b*, the screwdriver is rotated in the direction of arrow 52. Continued movement in the direction of arrow 52 will then reverse the rotation of the housing, moving it back, in the direction of arrow 53, to the initial position first shown in FIGS. 8 and 10. The connector 10 is then easily removed from the rail 12.

As may be seen, therefore, the present invention provides numerous advantages. Principally, it provides a very convenient, reliable, and tolerant ground clip for establishing an electrical ground connection to a grounding bus rail without the need for tools. The ground clip can be formed as a single piece, without requiring additional elements to ensure sufficient resiliency for commercial applications. An acceptable low level of contact resistance is thus assured. In the preferred embodiment, the bend axes are across the grain of the metal sheet, to maximally exploit the physical characteristics thereof.

Claim dependencies have been drafted to comply with PCT Rule 6.4, but it will be understood that, at least by virtue of this paragraph, any appropriate combination of the features disclosed and/or claimed herein is in itself an embodiment of the invention, and it is intended to use multiple dependent claims in the national phase where permitted.

Therefore, while the methods and forms of apparatus herein described constitute preferred embodiments of this invention, it is to be understood that the invention is not limited to these precise methods and forms of apparatus, and that changes may be made therein without departing from the scope of the invention.

What is claimed is:

1. A single piece connector ground clip for tool-lessly establishing an electrical ground connection to a multi-rim grounding bus rail, comprising:

a) a metallic sheet having longitudinal and transverse axes, b) a provision in said sheet for connecting to an electrical conductor to be grounded, and c) opposing fingers formed in said sheet for resiliently engaging a rim of such a grounding bus rail sufficiently to establish a low contact resistance electrical ground connection therewith, said fingers being formed in said sheet along bend axes substantially parallel to the plane defined by said longitudinal and transverse axes to provide for resilient flexing of said ground clip along the neutral line thereof for maximizing the flexibility and resiliency of said fingers when engaging such a rail, and said fingers being formed and spaced in said sheet such that they are flexibly spread when in a predetermined position on the rail to resiliently apply pressure to the rail for improved ground connection therewith.

2. The clip of claim 1 wherein at least one of said fingers further comprises a pivot for engaging the rim of such a rail for rotating said fingers around said pivot into said predetermined position on the rail.

3. The clip of claim 2 further comprising an entry wing on the end of at least one of said fingers opposed to said pivot, for engaging such a rail and resiliently prying said fingers open when rotated into said predetermined position, to provide for increasing the gripping force of said fingers on the rail and accommodating variations in rail sizes.

4. The clip of claim 1 wherein:

a) said clip further comprises a single metallic sheet having a spring portion therein, b) said fingers are formed in one end of said sheet, and c) said spring portion and said provision for connecting to a conductor are formed on said sheet such that said spring portion is between said provision and said fingers, said spring portion thereby at least partially mechanically decoupling said fingers from said provision for connecting.

5. The clip of claim 4 wherein said spring portion defines an S-shaped resilient fold in said sheet, and said provision for connecting to a conductor further comprises a pocket formed by said fold on the end of said sheet opposite said fingers for resiliently receiving and gripping a lead to be grounded.

6. The clip of claim 5 further comprising at least one entry wing on said pocket for resiliently prying said pocket open when such a lead is inserted into said pocket, to provide for increasing the gripping force of said pocket on the lead and accommodating variations in lead sizes.

7. A connector ground clip for tool-lessly establishing an electrical ground connection to a grounding bus rail, comprising:

a) a single metallic sheet having longitudinal and transverse axes, the grain of the metal being drawn in said longitudinal direction, and said sheet being formed into an S-shaped spring which defines a resilient fold in said sheet on one end thereof, said fold further defining a pocket for resiliently receiving and gripping a conductive lead to be grounded, b) at least one entry wing on said pocket for resiliently prying said pocket open when such a lead is inserted into said pocket, to provide for increasing the gripping force of said pocket on the lead and accommodating variations in lead sizes, c) opposing fingers formed in the end of said sheet opposite said pocket for resiliently engaging the rim of a grounding bus rail to establish an electrical ground connection therewith, said fingers being formed in said sheet along bend axes across the grain of said sheet and thus substantially parallel to the transverse axis of said sheet, said sheet being substantially free of bends around axes substantially parallel to the longitudinal axis thereof, to provide for resilient flexing of said ground clip along the neutral axis thereof for maximizing the flexibility and resiliency limits of said fingers when engaging such a rail, said S-shaped spring at least partially decoupling said fingers from said pocket, and said fingers being formed and spaced in said sheet such that they are flexibly spread when in a predetermined position on the rail to resiliently apply pressure to the rail for improved ground connection therewith, d) at least one of said fingers having a pivot for engaging the rim of such a rail for rotating said fingers around said pivot into said predetermined position on the rail, and e) an entry wing on the end of at least one of said fingers opposed to said pivot, for engaging such a rail and resiliently prying said fingers open when rotated into said predetermined position, to provide for increasing the gripping force of said fingers on the rail and accommodating variations in rail sizes.

8. A connector for mounting on and for tool-lessly establishing an electrical connection to a multi-rim grounding bus rail, comprising:

a) a housing having means for terminating at least one telecommunications conductor, b) rail-engaging members on said housing for engaging such a grounding bus rail and holding said housing thereon, c) a metallic sheet having longitudinal and transverse axes and being formed into a single piece ground clip on said housing for establishing a low contact resistance electrical ground connection to the grounding bus rail, d) a provision in said sheet for connecting to an electrical conductor to be grounded, and e) opposing fingers formed in said sheet for resiliently engaging a rim of such a grounding bus rail sufficiently to establish such a low contact resistance electrical ground connection therewith, said fingers being formed in said sheet along bend axes substantially parallel to the plane defined by said longitudinal and transverse axes to provide for resilient flexing of said ground clip along the neutral line thereof for maximizing the flexibility and resiliency of said fingers when engaging such a rail, said fingers being formed and spaced in said sheet such that they are flexibly spread when in a predetermined position on the rail to resiliently apply pressure to the rail for improved ground connection therewith, and said fingers being positioned on said housing such that said housing holds said ground clip in said predetermined position when said rail-engaging members are engaged on such a grounding bus rail.

9. The connector of claim 8 further comprising:

a) at least one component therein requiring an electrical connection to ground, b) an electrical connection between said component and said provision for connecting, and c) a releasable catch assembly incorporated into said rail-engaging members for releasably engaging such a rail to releasably hold said housing and said ground clip thereon.

10. A method for tool-lessly engaging a rim of a multi-rim grounding bus rail to establish an electrical ground connection therewith, comprising:

a) resiliently engaging opposite edges of a rim of such a grounding bus rail with respective opposing fingers formed in a single piece clip formed from a metallic sheet having longitudinal and transverse axes and including a provision for connecting to an electrical conductor to be grounded, and resiliently engaging the rim with the opposing fingers sufficiently to establish a low contact resistance electrical ground connection therewith, the fingers being formed in the sheet along bend axes substantially parallel to the plane defined by the longitudinal and transverse axes to provide for resilient flexing of the ground clip along the neutral line thereof for maximizing the flexibility and resiliency of the fingers when engaging such a rail, and b) said engaging step including positioning the lingers in a predetermined opposing position on the rail, and, while positioning the fingers in the predetermined position, flexibly spreading the fingers around at least one of the bend axes to resiliently apply pressure to the rail for improved ground connection therewith.

11. The method of claim 10 wherein said positioning step further comprises engaging the rim of such a rail with a pivot on at least one of the fingers and rotating the fingers around the pivot into the predetermined position on the rail.

12. The method of claim 11 further comprising, with an entry wing on the end of at least one of the fingers opposed to the pivot, engaging such a rail with the wing and resiliently prying the fingers open when rotated into the predetermined position, to provide for increasing the gripping force of the fingers on the rail and accommodating variations in rail sizes.

13. The method of claim 10, wherein:

a) the ground clip is a single metallic sheet having a spring portion therein, b) the fingers are formed in one end of the sheet, and c) the spring portion is between the fingers and the provision for connecting to a conductor, and further comprising:

by means of the spring portion, at least partially mechanically decoupling the fingers from the provision for connecting.

14. The method of claim 13 wherein the spring portion is an S-shaped resilient fold in the sheet, and the provision for connecting to a conductor is a pocket formed by the fold on the end of the sheet opposite the fingers for resiliently receiving and gripping a lead to be grounded.

15. The method of claim 14 further comprising, with at least one entry wing on the pocket, resiliently prying the pocket open when such a lead is inserted into the pocket, to provide for increasing the gripping force of the pocket on the lead and accommodating variations in lead sizes.

16. A method for tool-lessly engaging the rim of a grounding bus rail to establish an electrical ground connection therewith, comprising:

a) engaging the rim of such a grounding bus rail with a ground clip formed from a single metallic sheet having longitudinal and transverse axes, the grain of the metal being drawn in the longitudinal direction, the sheet having a spring portion forming an S-shaped resilient fold therein, a provision for connecting to an electrical conductor to be grounded, and opposing fingers formed in one end of the sheet for resiliently engaging the rim to establish an electrical ground connection therewith, the spring portion being between the fingers and the provision for connecting to a conductor, the provision for connecting to a conductor being a pocket formed by the fold on the end of the sheet opposite the fingers for resiliently receiving and gripping a lead to be grounded, and the fingers being formed in the sheet along bend axes across the grain of the sheet and thus substantially parallel to the transverse axis of the sheet, the sheet being substantially free of bends around axes substantially parallel to the longitudinal axis thereof, to provide for resilient flexing of the ground clip along the neutral line thereof for maximizing the flexibility and resiliency of the fingers when engaging such a rail, b) positioning the fingers in a predetermined position on the rail by engaging the rim of the rail with a pivot on at least one of the fingers and rotating the fingers around the pivot into the predetermined position on the rail, c) while positioning the fingers in the predetermined position, flexibly spreading the fingers around at least one of the bend axes to resiliently apply pressure to the rail for improved ground connection therewith, d) while positioning the fingers in the predetermined position, with an entry wing on the end of at least one of the fingers opposed to the pivot, engaging the rail with the wing and resiliently prying the fingers open when rotated into the predetermined position, to provide for increasing the gripping force of the fingers on the rail and accommodating variations in rail sizes, e) with at least one entry wing on the pocket, resiliently prying the pocket open when such a lead is inserted into the pocket, to provide for increasing the gripping force of the pocket on the lead and accommodating variations in lead sizes, and f) by means of the spring portion, at least partially mechanically decoupling the fingers from the pocket.

* * * * *